United States Patent [19]

White

[11] Patent Number: 4,926,786

[45] Date of Patent: May 22, 1990

[54] RESTAURANT SIGNALING DEVICE

[76] Inventor: Thomas C. White, P.O. Box 3208, 10 Lenhardt Ave., Trenton, N.J. 08619

[21] Appl. No.: 335,372

[22] Filed: Apr. 10, 1989

[51] Int. Cl.[5] ..... G08B 5/02

[52] U.S. Cl. ..... 116/324; 116/2; 116/321

[58] Field of Search ..... 116/50, 281, 283, 306, 116/307, 321, 323, 324, 2, 225; 40/411, 414, 427, 488, 584; 403/109, 378, 379; 248/542

[56] References Cited

U.S. PATENT DOCUMENTS

| | | | |
|---|---|---|---|
| 190,511 | 5/1877 | Osborn et al. | 116/281 |
| 1,013,582 | 1/1912 | Bedini | 116/283 |
| 1,603,751 | 10/1926 | Dunn | 116/324 |
| 1,714,333 | 5/1929 | Voss | 116/324 |
| 2,776,638 | 1/1957 | Whitaker | 116/324 |
| 2,853,045 | 9/1958 | Thomas | 116/324 |
| 3,758,694 | 9/1973 | Lobush et al. | 116/324 |
| 4,587,864 | 5/1986 | Kassai | 74/551.3 |
| 4,651,670 | 3/1987 | Silverwater | 116/268 |

FOREIGN PATENT DOCUMENTS

| | | | |
|---|---|---|---|
| 459828 | 10/1950 | Italy | 116/283 |

*Primary Examiner*—William A. Cuchlinski, Jr.
*Assistant Examiner*—W. Morris Worth
*Attorney, Agent, or Firm*—Ezra Sutton

[57] ABSTRACT

The device includes two separately movable indicators for conveying different messages, such as "service needed" or "check please." The device includes first and second actuator pins for moving the first and second indicators relative to a vertical housing, which is mounted on a tray support placed on a table.

12 Claims, 5 Drawing Sheets

RESTAURANT SIGNALING DEVICE

FIELD OF THE INVENTION

The present invention relates to a signaling device for conveying a plurality of messages in various environments, including restaurants.

BACKGROUND OF THE INVENTION

When one is dining in a restaurant and needs service, it is often inconvenient or difficult to attract the attention of the waiter. The prior art includes U.S. Pat. No. 1,603,751 to Dunn and U.S. Pat. No. 1,714,333 to Voss which describe restaurant signaling devices for attracting the attention of a waiter. However, these devices can only attract the attention of the waiter and do not convey a message. Thus, these prior art devices cannot convey a specific request to the waiter, such as a request for service, or a request for a check, or the like.

SUMMARY OF THE INVENTION

The present invention provides a restaurant signaling device which includes at least two indicator means, each of which is separately operable and each of which can be used to convey a particular message to a waiter as to the specific service required, whereby faster service can be performed. The invention is also relatively simple in construction, easy to operate, and easy to clean.

DESCRIPTION OF THE INVENTION

Figures 1, 1A:
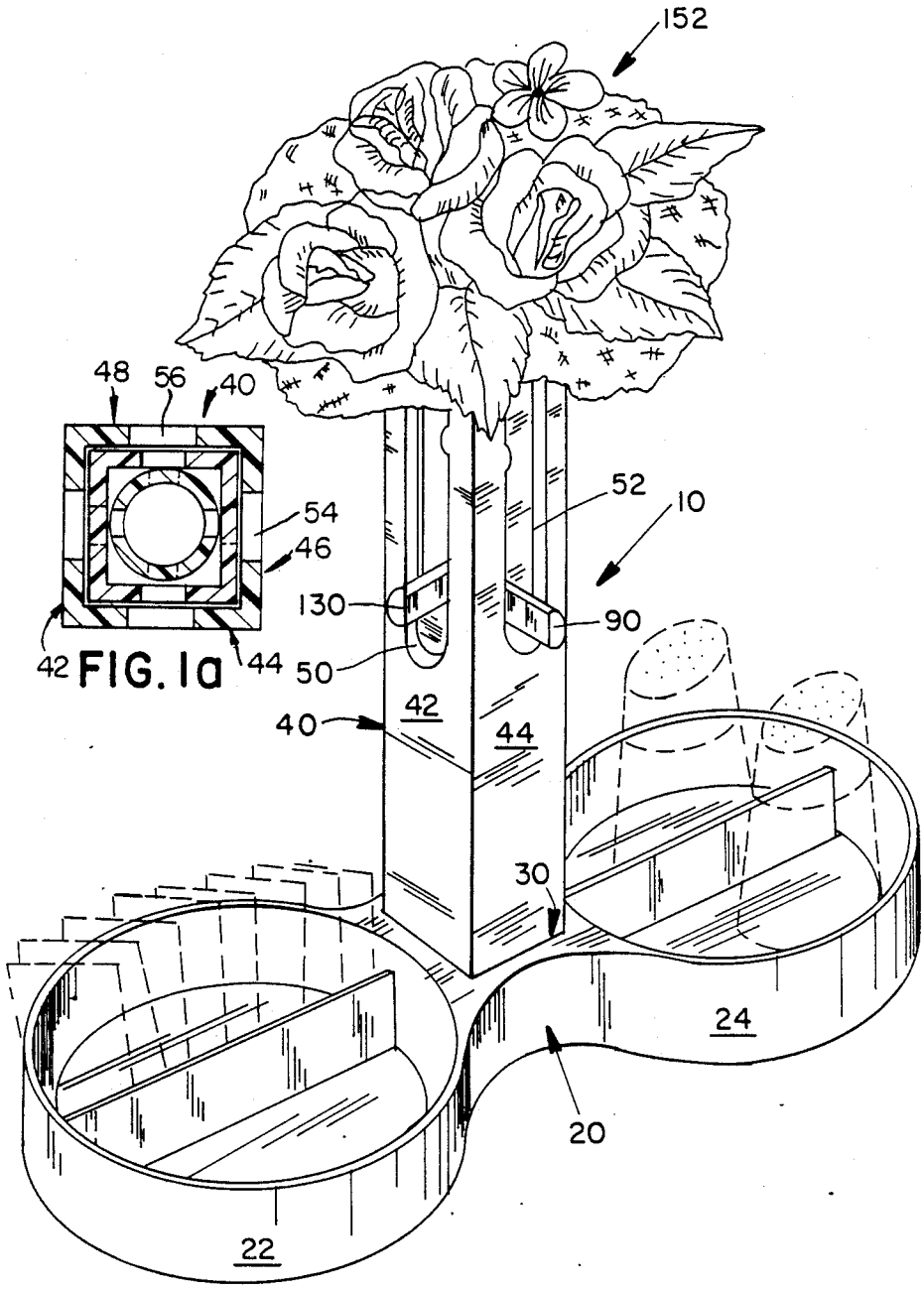
FIG. 1 is a perspective view of the invention.
FIG. 1*a* is a cross-sectional view of FIG. 1.
Figure 2:
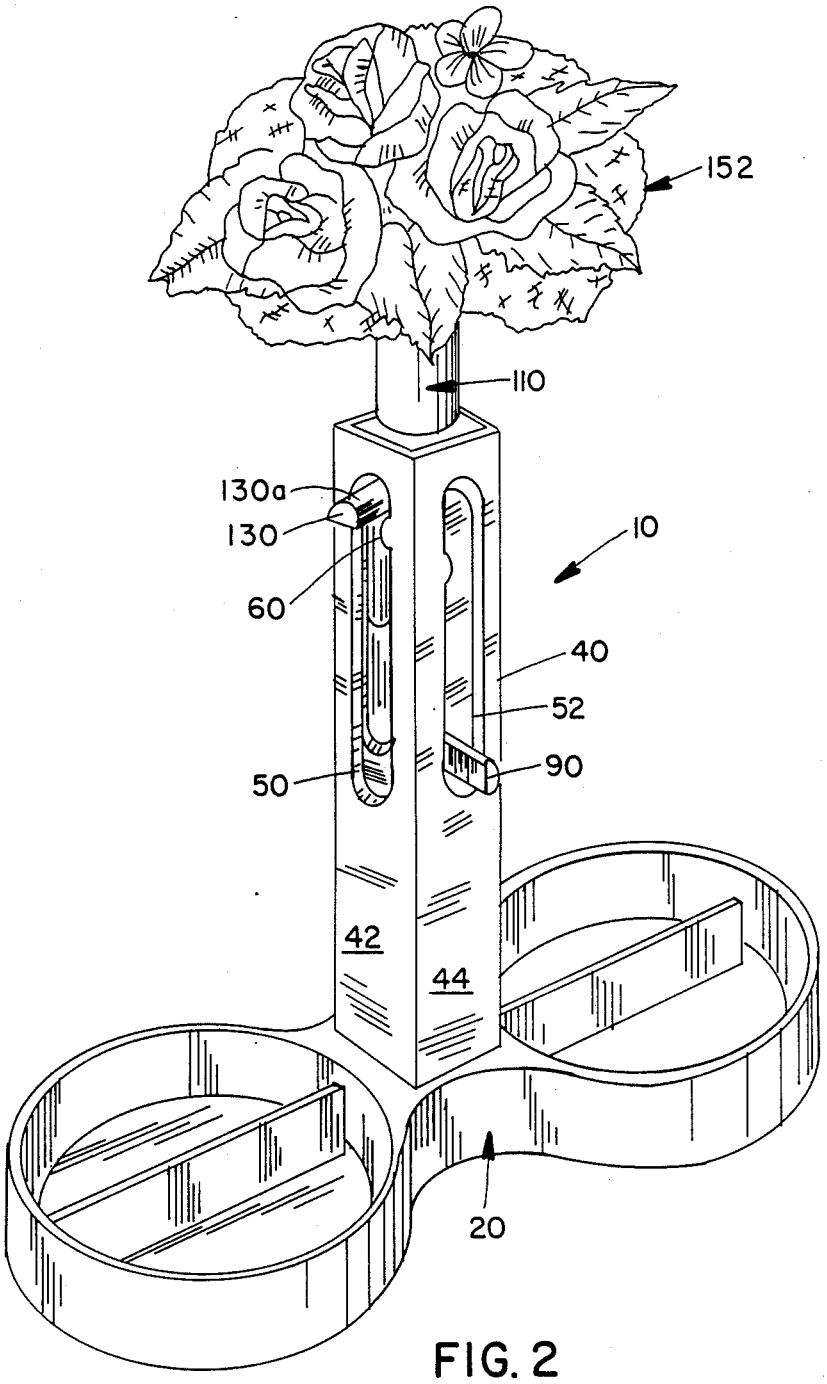
FIG. 2 is a perspective view of the apparatus of FIG. 1 illustrating operation of one signaling means thereof.

Referring to FIG. 1, there is shown a restaurant signaling device 10 embodying the present invention, which includes a base in the form of a tray 20 to be supported on a table in a restaurant. The tray 20 may take any suitable form and may, for example, include two portions 22 and 24, as shown, in which salt, pepper, sugar, and other condiments may be stored. The tray 20 and all parts of the device 10 may be made of a suitable material, such as plastic, wood, metal, or the like.

Figure 3:
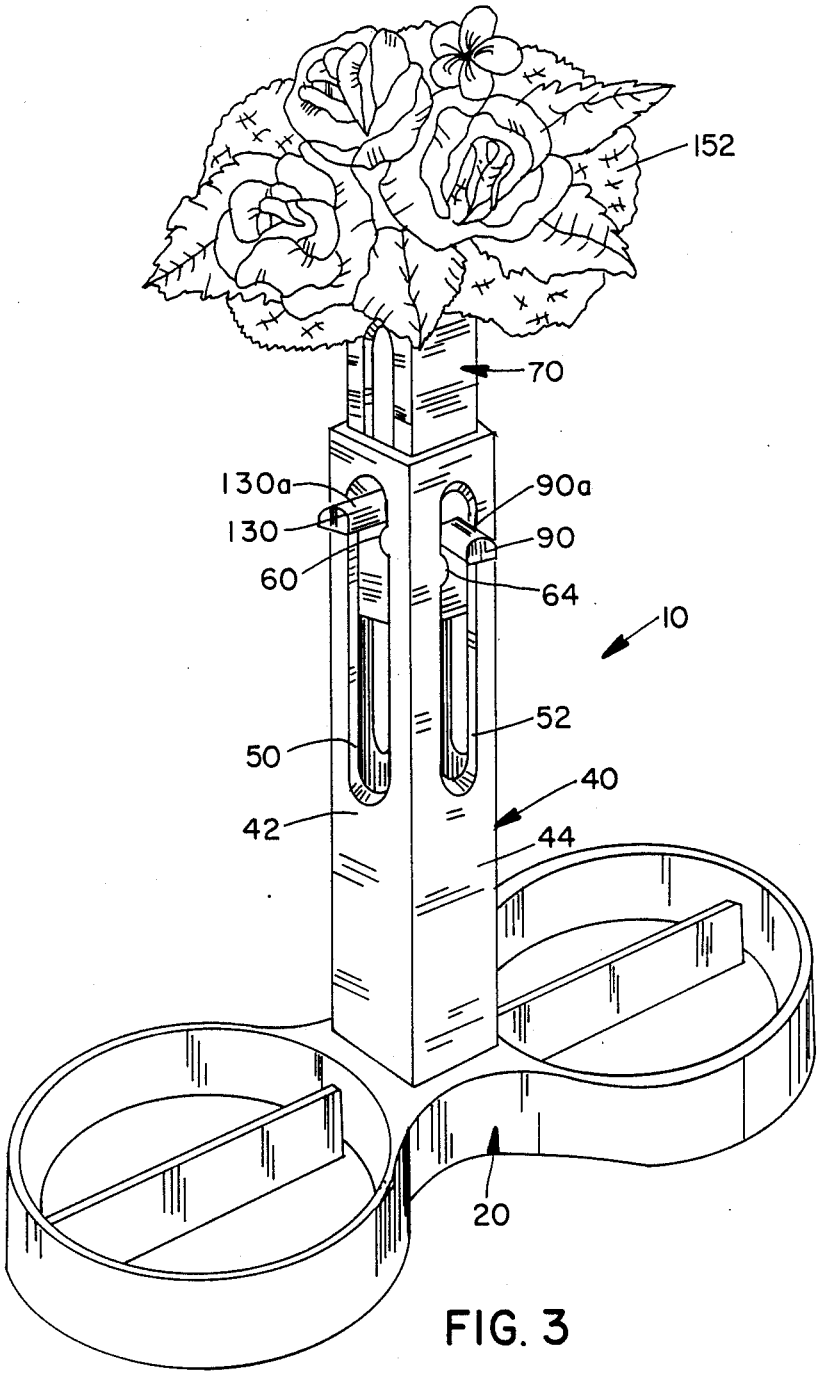
FIG. 3 is a perspective view of the apparatus of FIG. 1 illustrating the operation of a second signaling means thereof.

The tray 20 includes an opening 30 between the two portions 22 and 24 in which a vertical upstanding hollow housing 40 is removably inserted for support therein. The housing 40 is preferably rectangular in cross section and includes a first wall 42, a second wall 44, a third wall 46, and a fourth wall 48. It is noted that the first and third walls 42 and 46 are opposite each other, and the second and fourth walls 44 and 48 are opposite each other. The four walls of the housing are provided with respective slots 50, 52, 54, and 56, which extend vertically from about the center of the housing to near the upper end thereof. The slots 50 and 54 in the opposed walls 42 and 46 are generally in alignment with each other. The slots are of uniform width along their lengths, except that protrusions or bumps 60 are provided near the upper ends thereof to reduce their width slightly, for a purpose to be described below. Similarly, the slots 52 and 56 are of uniform width, except for protrusions or bumps 64 which narrow them for the same purpose. The bumps 64 in the latter slots are slightly lower in elevation than the bumps 60 in the slots 50 and 54, as shown in FIG. 3.

Figure 4A:
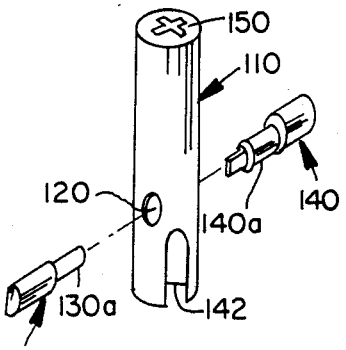
FIGS. 4*a*, 4*b*, and 4*c* are cross-sectional views of FIG. 4.
Figure 4A:
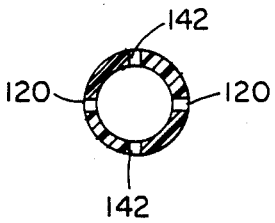
Figure 4B:
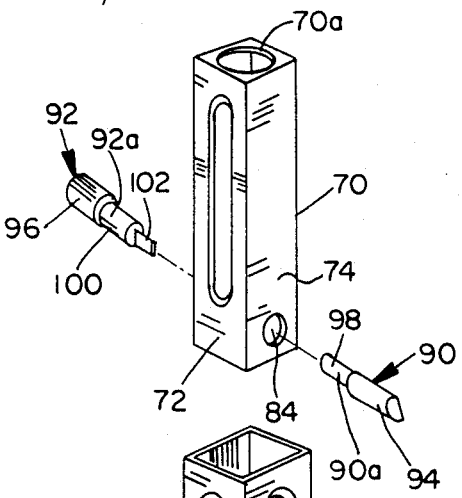
Figure 4B:
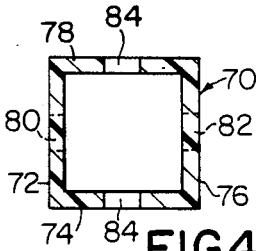
Figure 4C:
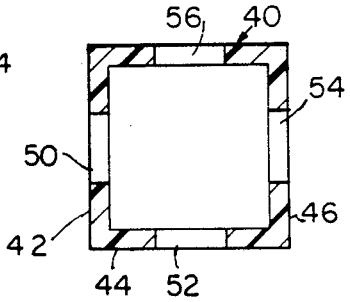
Figure 4:
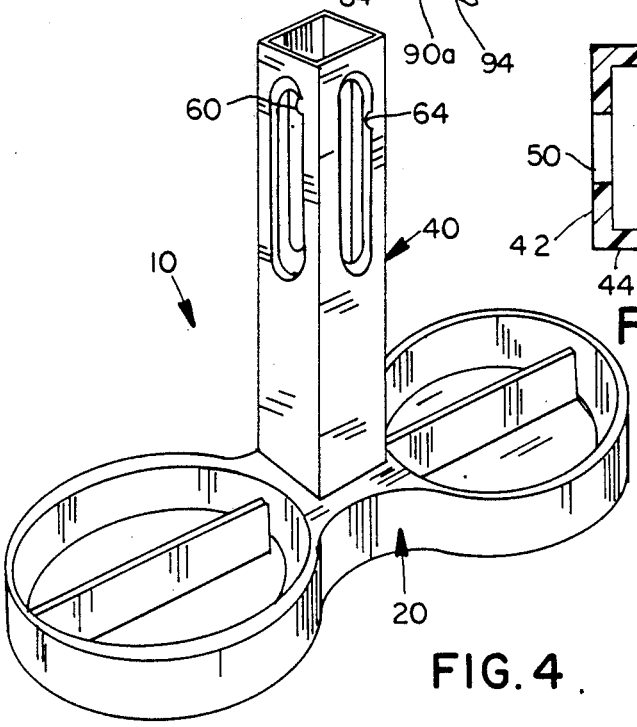
FIG. 4 is an exploded view of the invention showing the operating mechanism thereof.
Figure 5:
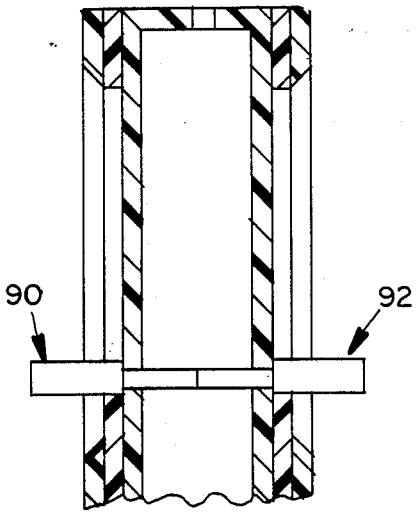
FIG. 5 is a sectional elevational view of a portion of the apparatus of the invention.
Figure 6:
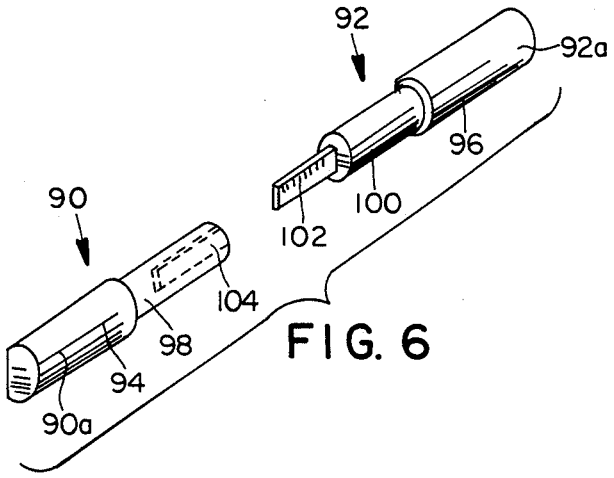
FIG. 6 is a perspective view of a locking means used in the invention.
Figure 7:
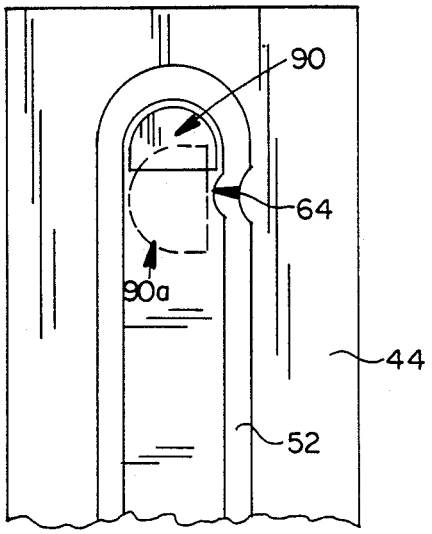
FIG. 7 is a side elevational view of a portion of the invention illustrating operation of the invention.

Referring to FIGS. 4, 5, and 6, the operating and signaling mechanism of the invention includes a first rectangular and movable signaling indicator 70 slidably mounted within the rectangular housing 40. The first indicator 70 includes four walls 72, 74, 76, and 78. Walls 72 and 76 include vertical slots 80 and 82, which are aligned with vertical slots 50 and 54 in housing 40. Walls 74 and 78 are provided with aligned holes 84 at their lower ends and a pair of actuator pins 90 and 92, which are inserted in the aligned holes 84 and are locked together therein. The actuator pins 90 and 92 are first inserted through housing slots 52 and 56 and then into aligned holes 84. They are similar in structure and include first outer finger gripping tubular portions 94 and 96 and adjacent inner tubular portions 98 and 100, which may be of smaller diameter and are seated for rotation in the aligned holes 84. Portion 96 carries a post 102 which is adapted to enter a hole 104 in portion 94 to couple the two pins together in a tight mechanical fit.

Referring again to FIG. 4, the device 10 includes a second signaling indicator 110, which is generally circular in cross section and is slidably mounted inside tube 70*a* in the first indicator 70. The second indicator 110 includes a pair of opposed aligned holes 120 near its lower end and in which actuator pins 130 and 140 are seated, after passing through housing slots 50 and 54 and first indicator slots 80 and 82. The wall of the second indicator 110 is also provided with opposed aligned slots 142 extending upwardly from their lower edge a short distance. In operating the indicators, as described below, the actuator pins 90 and 92 engage the slots 142, after passing through housing slots 52 and 56 and aligned holes 84. The actuator pins 130 and 140 coupled to the second indicator 110 are identical in construction to the pins 90 and 92 coupled to the first indicator 70.

The top surface 150 of the second indicator 110 may be notched or the like to receive a flower or other decorative device 152.

In using the signaling device 10 of the invention, the two indicators 70 and 110 may be made distinguishable from each other, for example, by being different colors, so that each can convey its own message, which may be printed on the walls of the housing 40 under the actuator pins associated with the particular indicator 70 or 110. Thus, for example, the second indicator 110 may be painted yellow and may be used to request general service. Under the pins 130 and 140, the message "push up for service" may be placed on the housing 40. Similarly, the first indicator 70 may be painted green and may be used to request a check and under its pins, 90 and 92, on the housing 40 may be placed the message "push up for check." It is clear that other colors may be used for the indicators and that other messages may be represented by each.

In using the signaling device 10, initially, the device is in the non-signaling mode, as seen in FIG. 1, with the first and second indicators in the lowered non-signaling positions. If it is desired to raise the inner or second indicator 110 for general service, the user pushes upwardly on the pins 130 and 140 associated with this indicator. When the actuator pins are above the protrusions 60 in the slots 50 and 54, the pins 130 and 140, having rounded surfaces 130*a* and 140*a*, are rotated to engage the protrusions, so that they cannot fall beneath the protrusions 60. The second indicator 110 is thus held in place in its elevated signaling position.

If it is desired to manipulate the first indicator 70, for example to request a check, the user pushes up on the pins 90 and 92, and the first indicator 70 either slides upwardly relative to the second indicator 110 (if indicator 110 is already in the raised position) or it engages the slots 142 and raises the second indicator with it as it moves to its signaling position. When the actuator pins 90 and 92 reach and rise above the protrusions 64 in the slots 52 and 56, they are rotated so that their rounded surfaces 90*a* and 92*a* engage the protrusions 64 to hold the indicator 70 in its raised position.

As will be understood, in accordance with the present invention, there has been provided a signaling device which can convey a plurality of messages in a simple and convenient manner.

A latitude of modification, change, and substitution is intended in the foregoing disclosure, and in some instances, some features of the invention will be employed without a corresponding use of other features. Accordingly, it is appropriate that the appended claims be construed broadly and in a manner consistent with the spirit and scope of the invention herein.

What is claimed is:

1. A restaurant signaling device, comprising:

a base in the form of a tray to be supported on a surface;

an upstanding hollow housing mounted on said base;

a first movable indicator within said housing and movable relative to said housing between a non-signaling and a signaling position to provide a first signal;

a second movable indicator within said housing and movable relative to said housing and relative to said first indicator between a non-signaling and a signaling position to provide a second signal;

said second movable indicator mounted within and movable relative to said first movable indicator; and means for maintaining said first and second indicators in their respective signaling positions.

2. The device defined in claim 1, wherein said upstanding hollow housing is removably mounted on said base.

3. The device defined in claim 1, wherein said housing includes slots and wherein said first and second movable indicators include at least a first and a second actuator, respectively, removably mounted thereon and for actuating said first and second movable indicators, respectively.

4. The device defined in claim 3, wherein said first actuator passes through said housing slots and through said first indicator and wherein said second actuator passes through said housing slots and through said first and second indicators.

5. The device defined in claim 3, wherein said first and second actuators are in the form of pins, including locking means formed thereon for locking said first and second indicators in said signaling positions.

6. The device defined in claim 5, wherein said pins are rotatably movable between a non-locking position and a locking position, and wherein said locking means include rounded surfaces formed on said pins.

7. The device defined in claim 6, further including protrusions extending into said slots formed in said housing for engaging said rounded surfaces on said pins to lock said pins in place and to maintain said first and second indicators in said signaling positions.

8. The device defined in claim 1, wherein said housing includes slots and wherein said first and second movable indicators include actuators which are slidable and rotatable in said slots and wherein said housing includes engaging means at the upper end of said slots for holding said actuators in place in said slots when said actuators are rotated in said slots.

9. The device defined in claim 1, wherein said upstanding hollow housing is generally rectangular in cross section and includes four surfaces, a vertical slot formed in each surface of said housing, the slots in the opposed surfaces of said housing being aligned with each other;

first actuator means rotatably coupled to said first movable indicator and being slidable and rotatable in the slots formed in two of the opposed surfaces of said housing;

second actuator means rotatably coupled to said second movable indicator and being slidable and rotatable in the slots formed in the other two of the opposed surfaces of said housing; and engaging means in each of said slots for reducing the width thereof, so that when said first and second actuator means are rotated in said slots, they engage and are held in position by said engaging means.

10. The device defined in claim 9, wherein said engaging means are in the form of first protrusions associated with said first indicator and second protrusions associated with said second indicator, said first and second protrusions being at different elevations.

11. The device defined in claim 1, wherein said second movable indicator includes means for mounting displays.

12. The device defined in claim 3, wherein said first movable indicator includes slots which are in alignment with said slots formed in said housing, and wherein said second movable indicator includes slots which are in alignment with said slots formed in said housing.

* * * * *